United States Patent [19]

Sporck

[11] Patent Number: 4,627,602

[45] Date of Patent: Dec. 9, 1986

[54] MECHANICAL LIFTING DEVICE

[75] Inventor: Claus L. Sporck, Cedar, Mich.

[73] Assignee: Hag A/S, Oslo, Norway

[21] Appl. No.: 739,998

[22] Filed: May 31, 1985

[30] Foreign Application Priority Data

Jun. 5, 1984 [NO] Norway ..... 842262

[51] Int. Cl.[4] ..... F16F 1/00; A47C 3/24

[52] U.S. Cl. ..... 267/182; 248/161; 248/188.2; 248/405; 248/406.1; 254/98; 297/345

[58] Field of Search ..... 267/131–133, 267/166, 168, 170–179, 182; 248/161, 162.1, 404, 405, 188.2, 406.1; 297/345, 347, 348; 254/104, 93 A, 93 R, 95–97, 98–103

[56] References Cited

U.S. PATENT DOCUMENTS

| | | | |
|---|---|---|---|
| 1,908,058 | 5/1933 | Runyan | 254/102 |
| 1,933,777 | 11/1933 | Traut | 254/102 |
| 2,674,301 | 4/1954 | Harting | 248/406.1 |
| 2,937,984 | 5/1960 | Chapellier | 254/93 A X |
| 3,116,089 | 12/1963 | Banzhaf | 267/132 X |
| 3,169,744 | 2/1965 | Nocek et al. | 248/405 |
| 3,206,153 | 9/1965 | Burke | 267/177 X |
| 3,799,485 | 3/1974 | Wolters | 248/406.1 |
| 3,893,730 | 7/1975 | Homier et al. | 267/131 X |
| 4,245,826 | 1/1981 | Wirges | 267/131 |
| 4,279,398 | 7/1981 | Pregnall | 248/405 |
| 4,285,488 | 8/1981 | Hancock | 248/405 |

FOREIGN PATENT DOCUMENTS

| | | |
|---|---|---|
| 0021813 | 1/1981 | European Pat. Off. . |
| 0615332 | 1/1980 | Switzerland . |

*Primary Examiner*—Douglas C. Butler
*Attorney, Agent, or Firm*—Darby & Darby

[57] ABSTRACT

A mechanical lifting device, preferably for a chair seat, comprising two reciprocally telescoping parts, one of which is attached to a chair support, whereas the other part is attached to the chair seat, both parts being mutually spring loaded, a locking screw being pivoted to the first part inside one of its ends and revolving about the longitudinal axis of the part, that the second part comprises an outer locking tube coaxially surrounding a hollow pressure rod and a number of locking nuts, e.g. three, intended for engagement with the locking screw and provided inside the locking tube, the locking nuts being mutually spring loaded and when the pressure rod is actuated enabling the locking screw to turn relative to the locking nuts when they move in the longitudinal direction of the lifting device, thereby the mutual position of the two parts is also changed. When actuation of the pressure rod stops a locking engagement is achieved between locking nuts and locking screw by the aid of the mutual spring load. The locking screw may be manufactured from a twisted polygonal, e.g. square, rod. The outer locking tube may e.g. have a hexagonal cross section, the locking nuts having an outer circumference corresponding to the inner cross section of the locking tube and central holes corresponding to the cross section of the locking screw. The pivotal mounting of locking screw is preferably supported by a resilient member. Furthermore, a shock absorbing function is obtained for the lifting device the locking screw being provided with a gasket sealing against the inside of the pressure rod.

9 Claims, 6 Drawing Figures

MECHANICAL LIFTING DEVICE

The present invention relates to a mechanical lifting device, preferably for a chair seat and comprising two reciprocally telescoping parts, one of which is attached to a chair support whereas the other is attached to the chair seat and both telescoping parts being reciprocally spring loaded.

Several kinds of elevating gear for chair seats, especially of the so called "gas lifter" type are previously known. Such lifting devices are often expensive and complicated in production and for a long time there has been a demand for simplification of such lifting devices in order to reduce costs as much as possible and to simplify the entire structure.

It is, thus, the object of the present invention to solve this problem.

The invention will now be disclosed in more detail with reference to the accompanying drawing which illustrates the lifting device according to the invention by reference to an embodiment.

Figure 1:
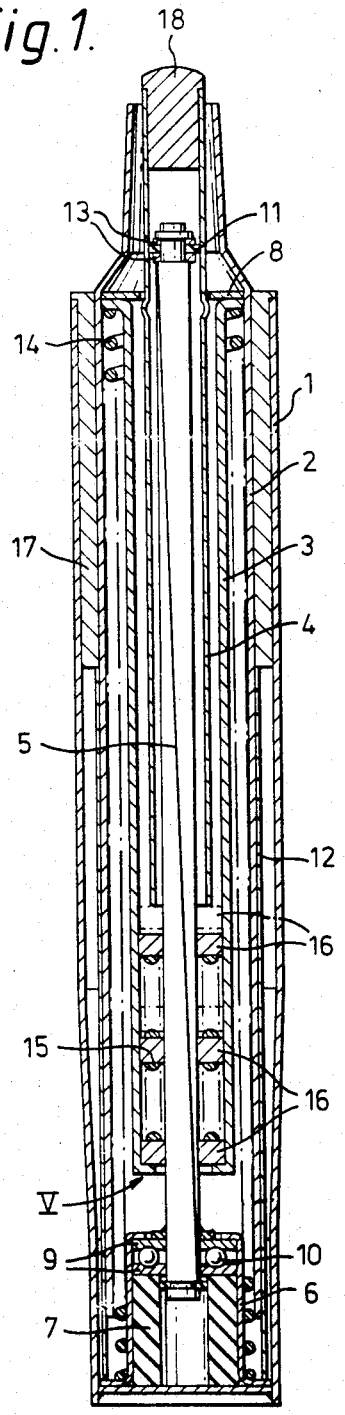
FIG. 1 shows the lifting device in a first position.
Figure 2:
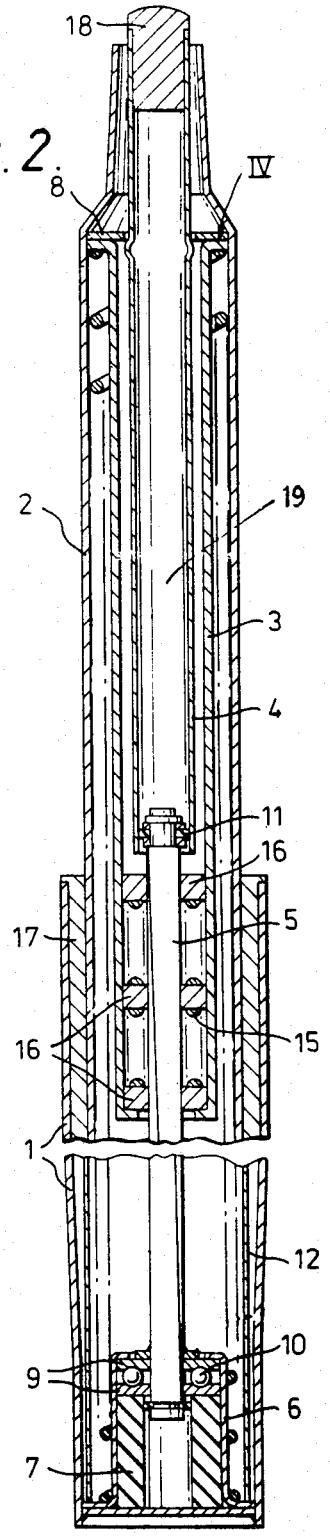
FIG. 2 shows the lifting device according to FIG. 1 in a second position.

In FIGS. 1 and 2 the lifting device is shown in detail. An exterior tube 1 has a lower portion which is conically narrowed. An elevating tube 2 is provided inside said exterior tube 1 and a plastic bushing or guide sleeve 17 is provided between said exterior tube 1 and said elevating tube 2 and secures a controlled guiding of the latter.

Inside said elevating tube 2 an outer locking tube 3 is provided and comprises an inner pressure rod 4. The hollow pressure rod 4 partly encloses a locking screw 5 along its entire length, as clearly seen in FIG. 1. Said locking screw 5 is at its lower end via a ball bearing 10 and washers 9 provided in a bearing housing 6 that is welded to the exterior tube 1. To achieve a certain degree of resilience in the bearing a resilient member 7 supporting the bearing 10 is provided in the bearing housing. Said locking screw 5 is at its upper end provided with a rubber gasket 11 supported by two disks 13 having a somewhat smaller radius, said rubber gasket 11, thus, forming a sliding connection with the inside of pressure rod 4. Said pressure rod 4 may be closed by a plug 18 at its upper end a pressure chamber being formed inside said pressure rod which pressure chamber 19 will have a certain shock absorbing effect when said pressure rod 4 is moved along said locking screw 5. To achieve that the two telescoping parts are able to move apart from one another a compression spring 14 is provided and rests against a disk 8 at its upper end and against a flange on the bearing housing 6 at its lower end.

Figure 3:
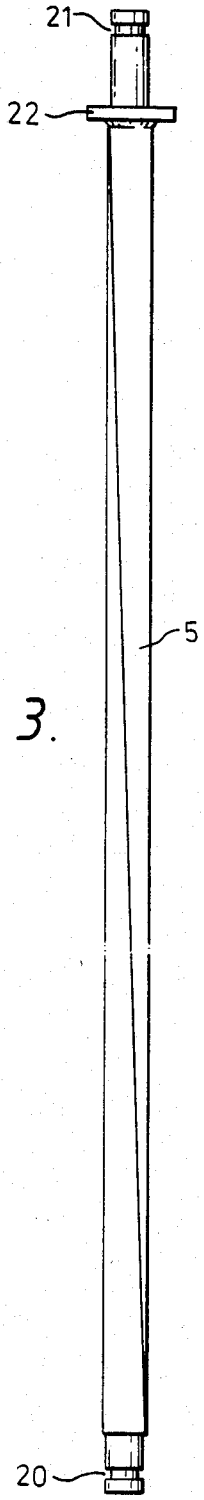
FIG. 3 illustrates an locking screw incorporated in the lifting device.

To permit a locking engagement between said reciprocal telescoping parts a number of locking nuts 16 mutually spring loaded by springs 15 is provided inside the lower portion of the outer locking tube 3. As indicated in FIG. 3, the locking spring 5 is manufactured from a twisted polygonal rod, e.g. a rod having a square cross section, and said locking nuts 16 will, then, have a central hole having a cross section corresponding to that of the locking screw. According to the shown embodiment the locking nuts have a polygonal outer circumference like the interior cross section of locking tube 3. Said spring members 15 will cause the thread pitch of the connected nuts 16 to be changeable. When pressure rod 4 is depressed it will influence the uppermost nut 16 and, thus the lower nuts as well. Thus, the pitch of the nuts is influenced and the nuts will only move upwards at the same time as locking screw 5 turns. Said screw 5 acting as riser means for said nuts 16. When pressure rod 4 is released the spring members 15 will return the nuts to a locking engagement with locking screw 5.

The lowest of the nuts (16), which preferably has only one turn of a thread, is located such that it will rise along the locking screw (5) when the locking screw is caused to rotate. The two uppermost of the nuts (16) will upon compression, i.e. by pushing the pressure rod (4) downward, be brought in phase with the lowermost nut (16) relative to the pitch of the locking screw (5) threads. Thereby, all three nuts are able to move freely along the locking screw (5) with mutually fixed relationship between the three locking nuts (16) until the influence of the pressure rod (4) is terminated, whereby the two springs (15) located between the respective pairs of nut (16) causes the two uppermost nuts to move out of phase relative to the lowermost nut. Thus, in this state, a wedging effect between the locking nuts and the locking screw is provided, and further mutual telescopic action between the parts of the lifting device is inhibited. It can be seen from the drawings that all three nuts (16) are preferably of the single thread, single turn type.

Reference number 12 in FIG. 2 denotes a guide tube made from plastic for the elevating spring 14.

In FIG. 3 the locking screw 5 is shown and in the chosen embodiment consists of a twisted square tube. It will, thus, be obvious that locking screw 5 can be manufactured in a very simple manner, disk 22 being welded to it and grooves 20, 21 being machined in a simple manner.

Figure 4:
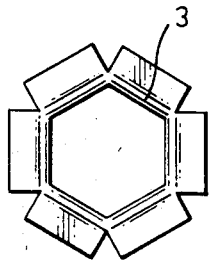
FIGS. 4 and 5 illustrate an outer locking tube, seen from above and from below respectively and being incorporated in the device according to the invention.
Figure 5:
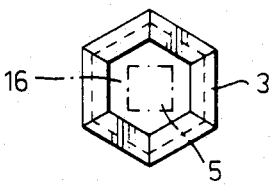
Figure 6:
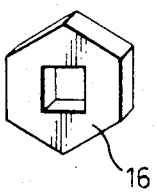
FIG. 6 illustrates a locking nut intended for engagement with the locking screw according to FIG. 3.

In FIG. 6 locking nut 16 is shown in perspective. FIGS. 4 and 5 illustrate the outer locking tube as seen from above and from below respectively, as indicated at IV and V in FIGS. 2 and 1 respectively.

It will be obvious that the pressure rod and locking nuts can be manufactured in any desired manner and need not have the shapes disclosed in the description and the Figures the embodiment shown and described only being intended as an example illustrating the inventive concept.

It will also be obvious that the lifting device disclosed and stated in the claims is not limited for use with sitting implements, e.g. chair seats, this usage only being intended as a non-limiting example.

I claim:

1. A mechanical lifting device adapted for use with a chair having a chair seat and a supporting chair subframe, which comprises:

an exterior tube, and an elevating tube mounted at least partially internally of the exterior tube, the exterior tube and elevating tube being movable mutually telescopically, one of the tubes being joined to the chair seat, and the other of the tubes being joined to the chair sub-frame;

an outer locking tube mounted to the elevating tube and disposed therein;

a hollow pressure rod coaxially surrounded by the outer locking tube;

an elongated locking screw at least partially received by the hollow pressure rod, the screw being mounted at one end to the exterior tube and pivotal about the longitudinal axis of the exterior tube, the locking screw having formed on its outer surface a thread of a predetermined pitch; and threaded nut means having an adjustable thread pitch and being adapted for selectively preventing pivotal movement of the elongated screw, the nut means being spring biased to be expandable and compressible in the longitudinal direction of the outer locking tube, the nut means including a plurality of spring biased threaded locking nuts arranged longitudinally with respect to the locking tube, and biasing spring means positioned between adjacent nuts, each locking nut having an individual thread pitch corresponding to the thread pitch of the elongated screw, each nut of the nut means engaging the screw, and engaging the outer locking tube so as to be non-rotatable with respect to the locking tube, the nut means being adapted to be compressed to a first state and expanded to a second state so that the distance between adjacent nuts is adjustable to be greater or less, respectively, wherein, when the nut means is in the first state, the thread pitch of the nut means is substantially different from that of the elongated screw to prevent the elongated screw from pivoting and when the nut means is in the second state, the threaded pitch of the nut means is substantially the same as that of the elongated screw to allow the screw to pivot.

2. A mechanical lifting device as defined by claim 1, wherein said nut means includes three locking nuts and a pair of compression springs, each spring being located between a pair of adjacent nuts.

3. A mechancial lifting device as defined by claim 1, wherein the locking screw is formed as a twisted polygonal rod.

4. A mechanical lifting device as defined by claim 3, wherein the locking screw rod has a square cross-section.

5. A mechanical lifting device as defined by claim 1, wherein the outer locking tube has a polygonal cross-section, and wherein each locking nut has a polygonal circumference corresponding to the internal cross-section of the locking tube and has a center hole cross-section corresponding to that of the locking screw.

6. A mechanical lifting device as defined by claim 5, wherein the outer locking tube has a hexagonal cross-section.

7. A mechanical lifting device as defined by claim 5, wherein each locking nut includes interior walls defining a center hole, the interior walls being planar and coaxial with the center hole.

8. A mechanical lifting device as defined by claim 1, wherein the other end of the locking screw is slidably received by the pressure rod, and wherein the pressure rod includes a gasket sealing mounted on said other end thereof, the gasket sealing being closely received by the hollow pressure rod to define with the pressure rod a shock absorbing chamber inside the pressure rod to provide the lifting device with a pressure action cushioning effect.

9. A mechanical lifting device as defined by claim 1, which further includes a resilient member mounted to the exterior tube for pivotally mounting the locking screw to the exterior tube.

* * * * *